United States Patent [19]

Golin

[11] 4,082,392

[45] Apr. 4, 1978

[54] GAS DISCHARGE LAMP PREPARATION PROCESS

[76] Inventor: Jeffrey R. Golin, Box 9959, Stanford, Calif. 94305

[21] Appl. No.: 673,476

[22] Filed: Apr. 5, 1976

[51] Int. Cl.[2] ..... H01J 9/38

[52] U.S. Cl. ..... 316/19; 316/20; 316/24

[58] Field of Search ..... 316/20, 19, 24; 65/36, 65/40, 41; 29/25.13, 25.15, 25.16

[56] References Cited

U.S. PATENT DOCUMENTS

| | | | |
|---|---|---|---|
| 2,324,557 | 7/1943 | Claesson et al. | 65/36 X |
| 2,694,273 | 11/1954 | Spyret | 65/40 |
| 2,697,311 | 12/1954 | Polan | 65/41 |
| 2,795,018 | 6/1957 | Shaw | 65/36 X |
| 3,151,967 | 10/1964 | Zurick | 65/36 X |
| 3,628,846 | 12/1971 | Cortorillo | 316/17 |
| 3,914,000 | 10/1975 | Beckerman et al. | 316/20 |

OTHER PUBLICATIONS

"Solder Glasses", by R. E. Hogan, in Jan. 1971 issue of Chem. Tech. at pp. 41–43.

*Primary Examiner*—Richard B. Lazarus
*Attorney, Agent, or Firm*—Phillips, Moore, Weissenberger, Lempio & Majestic

[57] ABSTRACT

The invention is concerned with a process for sealing a gas at elevated pressures within a gas discharge lamp without the necessity for freezing down the gas within the lamp. The process comprises providing a hollow vitreous body having an orifice leading from an exterior to an interior thereof and a first vitreous tube extending from said orifice externally of the body. The first tube and the interior of the body are pressurized with gas. A vitreous bead of a first type of glass is positioned in the first tube, the bead having a softening temperature below a softening temperature of the first tube and having a thermal expansion differential within about 1000 parts per million of the first tube. Without freezing down the gas the first tube and the bead are heated to a first temperature sufficient to soften the bead but not soften the first tube to wet and seal the first tube with the softened bead. Finally, the sealed tube is cooled. Also disclosed are a variety of apparatus for carrying out the above process.

8 Claims, 8 Drawing Figures

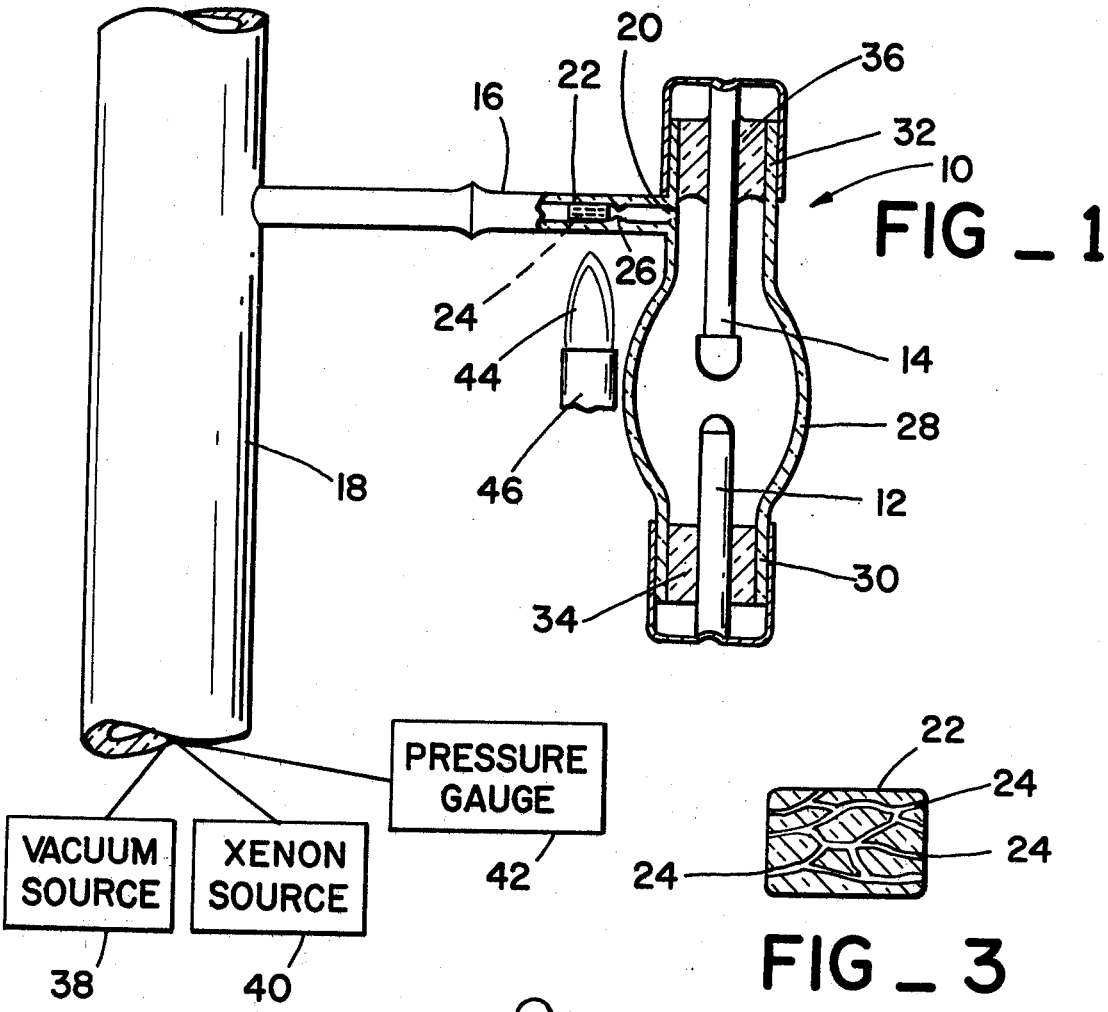
FIG _ 1
FIG _ 3
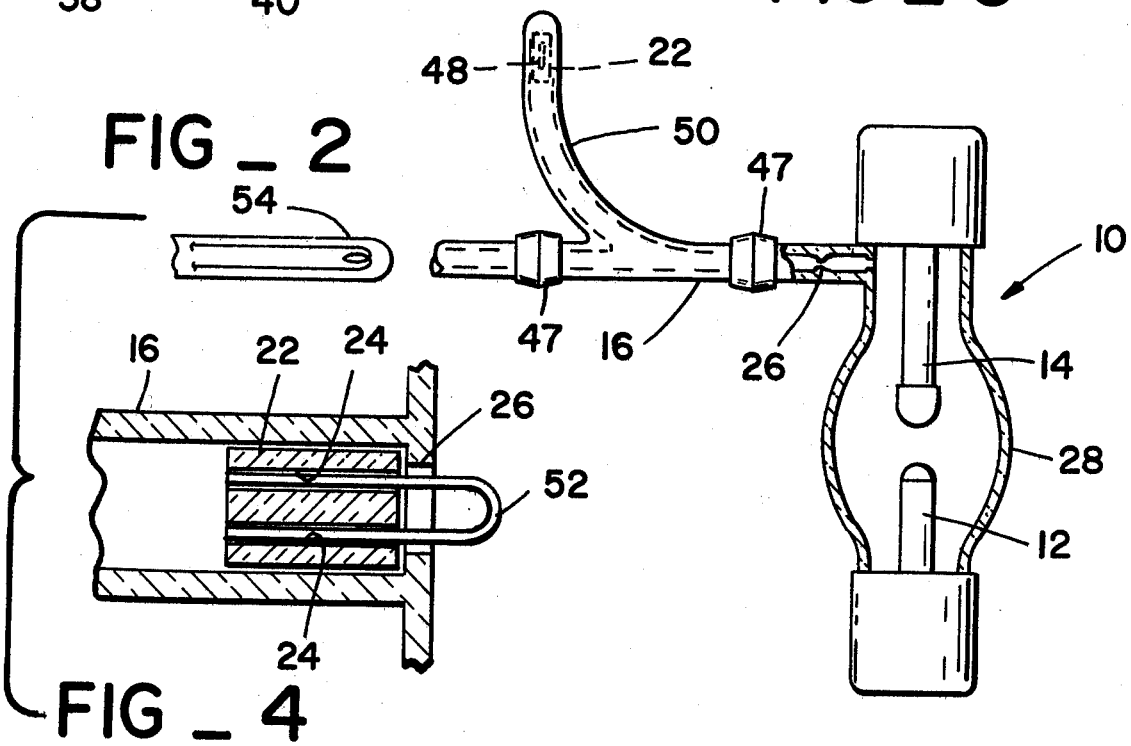
FIG _ 2
FIG _ 4

GAS DISCHARGE LAMP PREPARATION PROCESS

BACKGROUND OF THE INVENTION

1. Field of the Invention

The invention is concerned with the preparation of gas discharge lamps such as xenon containing lamps which also contain a cathode(or cathodes) and an anode therein. Typically the cathode of such lamps is of a refractory metal such as tungsten. Connection between the internal cathode and anode of the lamp and the exterior of the lamp generally occurs via a glass-to-metal sealing of an extension of each of the anode and cathode which extensions pass through the wall of the lamp. Typically, the extensions of the anode and of the cathode are made of molybdenum, tungsten or of another metal having a thermal expansion differential generally within about 1000 parts per million of the lamp wall. Such gas discharge lamps generally operate at a relatively high temperature thus requiring the use of a relatively high temperature glass.

2. Prior Art

The production of high temperature gas discharge lamps with above atmospheric gas pressure therewithin has generally consisted of sealing via quartz-to-metal seals the anode and the cathode of the lamps within the hollow vitreous body thereof. The lamps have generally had a tube extending from an orifice which goes through the wall of the hollow vitreous body, which tube has been attached to a manifold which has been in turn attached via glass stopcocks, metal valves or other valving means to a vacuum pump to allow for complete evacuation from the lamp of all gases therein. Once the lamp has been sufficiently evacuated, the vacuum pump has been shut off from the manifold, and the manifold and thus the lamp have been then generally filled with a measured pressure of the gas to be used to fill the lamp, e.g., xenon gas. The xenon gas in a known volume, which will generally include the volume of the manifold, has then been frozen down within the lamp to form liquid or solid xenon. Alternately a measured volume of liquid xenon is frozen down within the lamps. This has generally been accomplished by bringing a liquid nitrogen containing dewar flask into position about the lamp whereby the liquid nitrogen therein contacts the lamp and causes it to be brought to a temperature well below the freezing temperature of the xenon. After the xenon has been frozen into the hollow vitreous body of the lamp, the tube which proceeds therefrom has then been generally sealed using conventional torch sealing techniques. A serious problem with such a procedure has been premature freezing of the xenon into the tube which is to be sealed off. This has led to clogging of the tube.

When the lamp body is of the usual quartz construction, the tube extending therefrom is usually of the same material and hence the sealing off of the tube generally requires sealing it to a relatively high temperature via a so-called "bright seal" thus requiring much experience and skill on the part of the operator sealing off the tube. Also, the formation of the position of joinder of the tube to the lamp adjacent the orifice which enters the lamp requires working with the relatively high temperature quartz and requires great skill and "bright seal" techniques. Further, because of the very high temperature gradient between the portion of the lamp which is in contact with the liquid nitrogen and the portion of the lamp which is sealed off at a temperature above the softening temperature of quartz, serious thermal strains can result in the structure thus limiting its effective lifetime at the high operating conditions of xenon gas discharge operation. Annealing of the lamp to some extent tends to overcome this problem but it has been found that in practice annealing alone does not completely eliminate thermal strain problems introduced by such a sealing procedure. Very importantly, when operating with a technique as described above it has proven difficult to assure that precisely the desired amount of xenon will be trapped within each lamp despite careful measurement of the volumes and pressures involved. Filling to outside these narrow pressure limits leads to a significant rate of rejection of lamps because such xenon lamps are extremely sensitive to small variations of lamp fill pressure. Overfilling adversely affects lamp life, whereas underfilling adversely affects luminosity. Yet further, the above procedure is quite time consuming requiring carefully made relatively high temperature "bright seals" manually prepared by skilled workers for each individual lamp being prepared and has generally required the use of quartz manifolds or graded glass-to-quartz sealing and/or a metal vacuum system and metal-to-quartz graded sealing and the like in the vacuum system used to fill the lamps thus increasing both the cost of the materials of the manifold and the time required to put it together.

The present invention provides solutions to each of the above set out problems.

SUMMARY OF THE INVENTION

In one sense the invention comprises a process for sealing a gas within a high pressure electronic tube such as a gas discharge lamp. The process comprises providing a hollow vitreous body having an orifice leading from an exterior to an interior thereof and a first vitreous tube extending from the orifice external of the body. The first tube and the interior of the body are pressurized with a gas. A vitreous bead of a first type of glass is positioned in the first tube. The bead has a softening temperature below a softening temperature of the first tube and has a thermal expansion differential within about 1000 parts per million of the first tube. The first tube and the bead are heated without freezing the gas to a first temperature intermediate the softening temperature of the bead and the softening temperature of the first tube to seal the first tube with the softened bead. Finally, the sealed tube is cooled.

In another sense the invention comprises apparatus for forming a high pressure electronic tube such as a gas discharge lamp by sealing a gas within a hollow vitreous body having an orifice leading from an exterior to an interior thereof and a first vitreous tube extending from the orifice externally of the body. The apparatus comprises means for pressurizing the first tube and the interior of the body with a gas. The apparatus further comprises means for positioning a vitreous bead of a first type of glass having a softening temperature below a softening temperature of the tube and a thermal expansion differential within about 1000 parts per million of the first tube therewithin. Further, the apparatus comprises means for heating the first tube and bead without freezing the gas to a first temperature intermediate the softening temperature of the bead and the first tube to seal the first tube with the bead.

It is an object of the present invention to provide an improved process for sealing a gas within a gas discharge lamp or similar high pressure electronic tube at its directly readable use pressure and which does not require freezing of the gas within the lamp.

It is a further object of the invention to provide a process for sealing a gas within a gas discharge lamp or similar high pressure electronic tube wherein thermal strains are minimized by not heating any portion or extension of the lamp to a sufficient temperature to soften it and by not having one portion of the lamp at a very low temperature while another portion of the lamp is being sealed at a very high temperature.

Still another object of the invention is to provide a process for sealing a gas within a gas discharge lamp or similar high pressure electronic tube which does not require the use of quartz as the vitreous material from which the lamp is formulated thus allowing somewhat more conventional glass working techniques to be utilized rather than extreme high temperature glass working techniques.

Another object yet of the invention is to provide a process for sealing a gas from a gas discharge lamp or similar high pressure electronic tube wherein a plurality of such lamps can be sealed in a single operation through utilization of a furnace and wherein the use of a torch is not required.

A further object yet of the invention is to provide a process for sealing a gas within a gas discharge lamp or similar high pressure electronic tube and at the same time sealing the electrodes within said lamp.

Further objects of the invention include providing apparatus for carrying out each of the above set out processes.

These and other objects of the invention as will become apparent from the description which follows are accomplished as set out herein.

BRIEF DESCRIPTION OF THE DRAWINGS

The invention will be better understood by reference to the figures of the drawings wherein like numbers denote like parts throughout and wherein:

FIG. 1 illustrates a first embodiment of an apparatus for carrying out the process of the present invention;

FIG. 2 illustrates a second embodiment of apparatus suitable for carrying out the process of the present invention;

FIG. 3 illustrates a third embodiment of apparatus suitable for carrying out the process of the present invention;

FIG. 4 illustrates a fourth embodiment of apparatus suitable for carrying out the process of the present invention;

DESCRIPTION OF THE PREFERRED EMBODIMENTS

Figure 5:
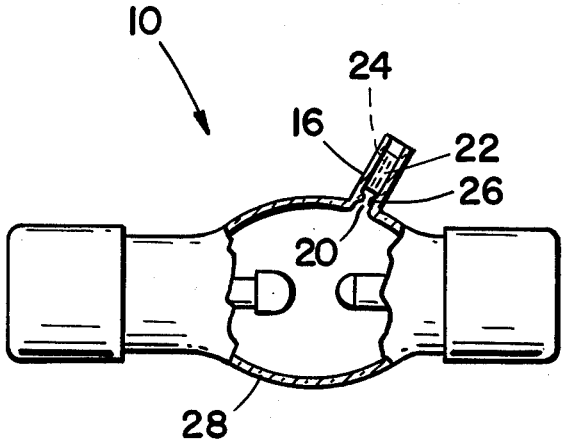
FIG. 5 illustrates a fifth embodiment of apparatus suitable for carrying out the process of the present invention.

Referring first to FIG. 1 there is illustrated therein a lamp 10 having an anode 12 and a cathode 14 therewithin and attached via a tube 16 to a vacuum system 18. The tube 16 communicates with the interior of the lamp 10 via an orifice 20. Within the tube 16 there is positioned a bead 22 having an opening 24 leading therethrough. The tube 16 generally includes a shoulder 26 therewithin between the bead 22 and the interior of the tube 16 with the bead 22 being positioned substantially against the shoulder 26. The lamp 10 includes a body 28 and a pair of ends 30 and 32 with the anode 12 entering the end 30 and the cathode 14 entering the end 32. Glass to metal seals 34 and 36 respectively serve to seal the ends 30 and 32 to the anode 12 and the cathode 14. Generally, the tube 16 which forms a part of the lamp 10 is made of the same vitreous material as is the body 28 thereof. This assures minimum strain at the point of seal of the tube 16 to the body 28 of the lamp 10 adjacent the orifice 20.

While it has been conventional to use quartz to form the body 28 and the tube 16 and while quartz is suitable for use in the practice of the present invention, a great advantage of the present invention is that the material of the body 28 and the tube 16 can be a somewhat lower melting material than quartz. For example, the lamp 10 can be formulated of a borosilicate glass such as Corning Pyrex glass or more preferably of an aluminosilicate glass such as Corning glass Code No. 1720 or 1723 as described in detail in Corning "Material Information" published December, 1973 by Corning Glassworks, Corning, N.Y. or Kimble EE-2 glass. The approximate composition of the Corning Code 1723 glass in weight percent is silica 57, alumina 15, boron trioxide 5, magnesium oxide 7, calcium oxide 10, and barium oxide 6. The term aluminosilicate glass as used herein means generally a glass having at least about 35 percent silica and at least about 5 percent alumina. Preferably the silica content will fall within a range from about 35 percent to about 80 percent and the alumina content will fall within a range from about 5 percent to about 35 percent, all of said percents being by weight. More preferred weight percent ranges are silica about 45 to 70 percent and alumina about 7 to 25 weight percent. It is of course understood that the invention is not limited to a glass of any particular composition so long as that glass will satisfy the required operational characteristics thereof set out in following. A glass of about the particular compositions of Corning Code 1720 or 1723 aluminosilicate glass however is particularly useful in that its thermal expansion differential with molybdenum and tungsten is relatively small, generally below 300 ppm thus making electrode sealing thereto quite straightforward. Also, such glass is quite hard and is in fact harder than quartz having a Knoop hardness of 514 as compared to a Knoop hardness of 489 for quartz. Further, this particular glass has a particularly high strain point of 665° C as opposed to 510° C for borosilicate glass. Along with this relatively high strain point as compared to borosilicate glass, the Corning Code 1720 or 1723 glass or its equivalent has a high upper working temperature of about 650° as opposed to about 490° C for borosilicate glass. Quartz of course exceeds both the strain point and upper working temperature of any of the normal glasses. Further, the thermal shock resistance of the preferred aluminosilicate glass is quite comparable to that of borosilicate glass such as Corning Pyrex glass although not quite as high. Also, such a glass is readily sealable to lower temperature glasses thus allowing its use on vacuum systems made of borosilicate glass or the like.

Sealing of xenon or the like within the lamp 10 proceeds as follows: First, the lamp 10 is evacuated through pumping on the vacuum system 18 with a vacuum source 38 such as a typical vacuum pump. The vacuum source is then isolated from the system which includes the lamp 10 and xenon gas is introduced into the lamp and into the rest of the vacuum system 18 from a xenon source 40. It is to be understood that gases other than xenon can likewise be added to lamps. The pressure of xenon is raised as measured directly by a pressure gauge 42 of any desired type until the pressure is equal to that desired within the lamp 10. The xenon gas enters the lamp 10 via the opening 24 in the bead 22. A flame 44 from a torch 46 is then applied to the tube 16 about the location of the bead 22 therein. The tube 16 and thereby the bead 22 are heated to a temperature between a softening temperature of the bead 22 and a softening temperature of the tube 16. A slight increase in pressure occurs as a result of this localized heating. This causes the opening 24 to collapse and close and at the same time causes the bead 22 to wet and seal off the tube 16. A slight increase in pressure occurs as a result of this localized heating. The shoulder 26 within the tube 16 serves to aid in directing the flow of the softened bead 22 so that it fully seals the tube 16. Thus, it will be seen that sealing of xenon within the lamp 10 takes place without any freezing down of the xenon therein and wherein the pressure within the lamp 10 must be precisely that directly measured by the pressure gauge 42 (It being understood that this pressure will go up somewhat during the time the flame 44 is applied to the tube 16).

Referring now to FIG. 2 there is illustrated an embodiment wherein the pressurizing of the lamp 10 occurs prior to the positioning of the bead 22 within the tube 16 and wherein the bead 22 does not necessarily have an opening 24 therethrough. In the embodiment illustrated in FIG. 2, the lamp 10 is pressurized with gas from the xenon source 40 or the like and thereafter the bead 22 is transferred within the tube 16 generally against the shoulder 26 therein as by tilting the entire apparatus, rotating about a pair of fittings 47, or including a ferromagnetic metal piece 48 within the bead 22 and then causing movement of the bead 22 by bringing a magnet thereadjacent. In this embodiment as will be noted the bead 22 is in a branch tube 50 which proceeds from the tube 16 at a position further removed from the orifice 20 then is the shoulder 26. Sealing of the bead 22 then proceeds exactly as previously described via a flame 44 of a torch 46.

Turning now to FIG. 3 there is illustrated another embodiment of the invention wherein the bead 22 instead of having a single opening 24 therethrough is of the fritted glass variety and thus has a plurality of small openings 24 therethrough. The particulars of filling and sealing the lamp 10 are then precisely as are the particulars described with respect to the embodiment shown in FIG. 1.

Turning now to FIG. 4 there is illustrated still another embodiment of the invention wherein the bead 22 has an opening or openings 24 therethrough and wherein an electromagnetic energy absorbing member 52, generally a metal member having a thermal expansion differential within 1000 ppm of the bead 22, loosely fits within the opening or openings 24. In this embodiment of the invention, filling of the lamp 10 with xenon or the like proceeds as described with respect to the embodiment shown in FIG. 1 and then sealing of the lamp 10 or more particularly of the tube 16 extending therefrom occurs through use of a flash source 54 rather than through use of a torch 46. In particular, the flash source 54 is set off adjacent the bead 22 whereby the electromagnetic energy absorbing member 52 absorbs energy from the electromagnetic energy source 54 which would generally be a flash source thus causing the temperature of the electromagnetic energy absorbing member 52 to greatly increase whereby the bead 22 is conductively heated and softened and thereby caused to seal off the tube 16. In this embodiment the electromagnetic energy absorbing member 52 is chosen from materials which are selectively transparent to the energy to be produced by the lamp 10 so that softening of the bead 22 does not occur during operation of the lamp 10.

Figure 6:
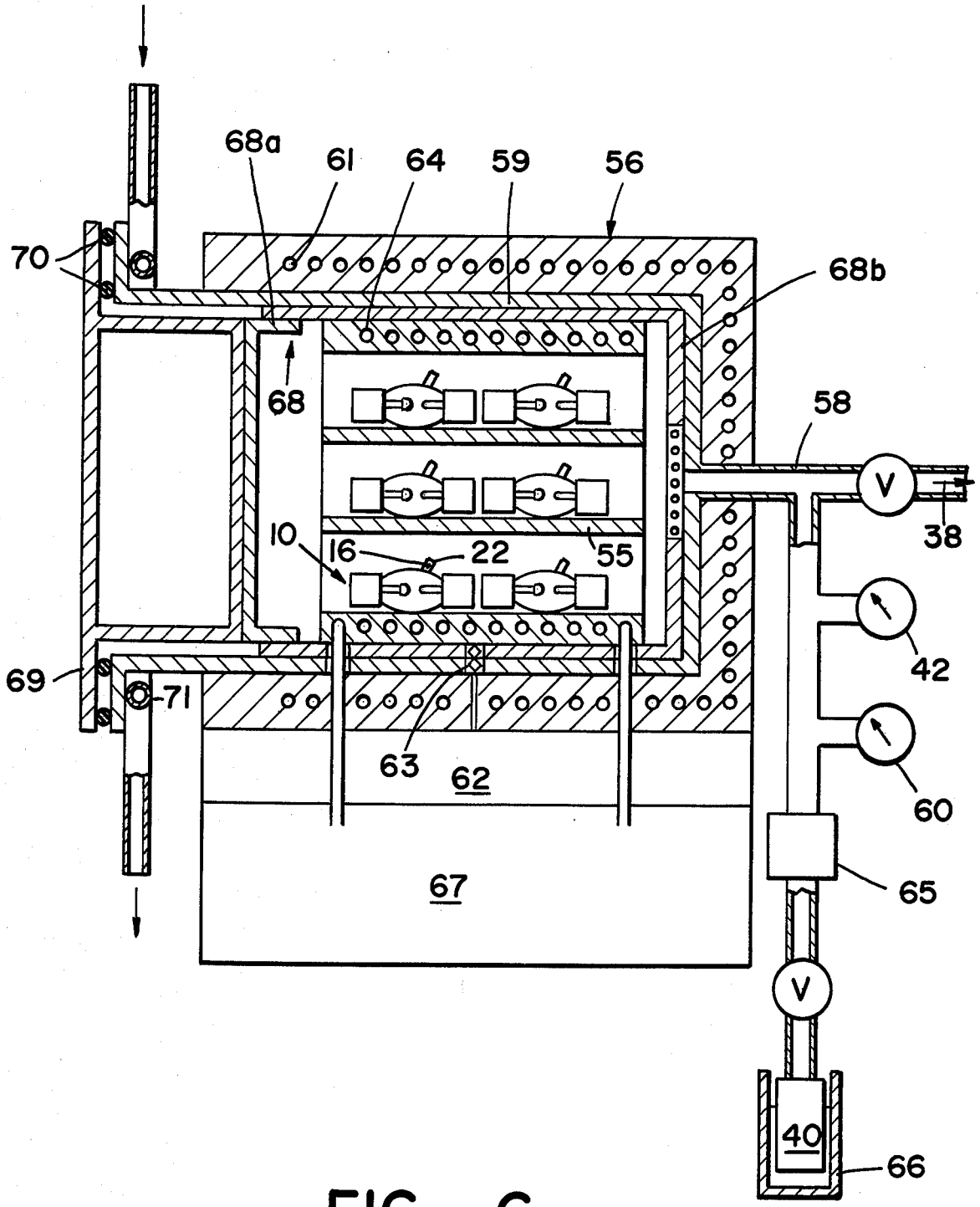
FIG. 6 illustrates a sixth embodiment of apparatus suitable for carrying out the process of the present invention.

Referring now to FIG. 5 there is illustrated a lamp 10 with a tube 16 extending therefrom having a bead 22 therein held in place upon a shoulder 26 within the tube 16 adjacent the orifice 20. FIG. 6 illustrates a plurality of lamps 10 as shown in FIG. 5 standing on a plurality of shelves 55 and on a bottom portion within a furnace 56 which connects to the vacuum system 18 via a conduit 58. The furnace 56 contains a vacuum-pressure vessel 59 which can be evacuated and also pressurized with fill gas at a high temperature, which pressure can be directly measured via a vacuum gauge 60 and the pressure gauge 42. The vessel 59 is preferably made of a high temperature nickel alloy, such as Inconel (trademark of Castle Metals). Also, the furnace 56 includes a plurality of heating coils 61 therein which allows its temperature to be controlled by controller 62 as desired and as measured via a thermometer, a thermocouple (as illustrated) or other temperature measuring means 63. In operation, the entire inside of the furnace 56 is evacuated via the vacuum system 18 and the lamps 10 are baked out by heating coils 60 at a temperature below the temperature of softening of the beads 22. The cathodes 14 are then activated by radio frequency heating by coils 64, in the case of oxide coated or impregnated electrodes. The respective lamps 10 are then filled with gas as by introducing, for example, xenon gas, from a xenon source 40 generally via a noble gas purification module 65. The xenon gas pressure within the furnace 56 and hence within the lamps 10 is measured directly as with respect to the embodiment shown in FIG. 1 using pressure gauge means such as the pressure gauge 42. Once the desired pressure has been attained the introduction of xenon is terminated and the temperature of the furnace 56, which is initially below the softening temperature of the beads 22, is raised to be intermediate the softening temperature of the beads 22 and the softening temperature of the tube 16. Sealing then takes place as with respect to the embodiment illustrated in FIG. 1. Finally, the furnace 56 is slowly cooled to allow the lamps to anneal, and the valuable excess xenon gas is frozen back into the source 40 by adding liquid nitrogen to the surrounding dewar flask 66. The furnace may also contain the radio frequency induction heating coil 64 connected to a radio frequency generator 67 for selectively activating the cathode 14 in vacuum prior to filling and sealing in the case of barium aluminum carbonate impregnated, oxide coated or similar cathodes.

In this event the interior of the vacuum pressure vessel 59 is lined by a magnetic shielding enclosure 68, with a lid 68*a*, and a container 68*b*, to prevent dissipation of radio frequency energy in the metal vessel 59. This allows the entire operation to be carried out automatically if desired, within the furnace 56. Entrance to the furnace 56 is via an insulated door 69 sealed with O-rings 70 and cooled via a conduit 71.

Figure 7:
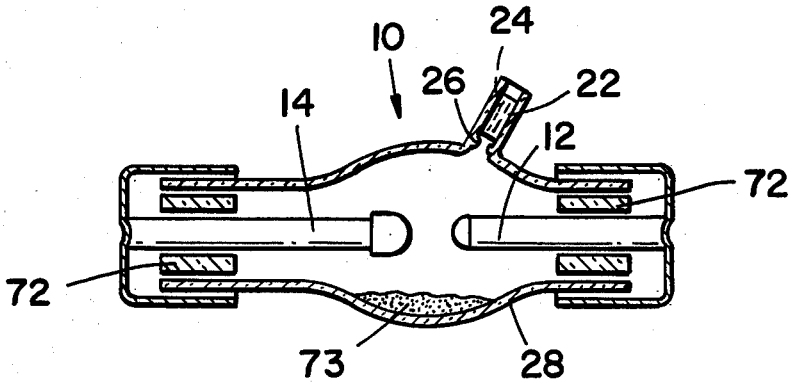
FIG. 7 illustrates a lamp sealable by the process of the present invention in the apparatus shown in FIG. 6 wherein means are provided for sealing the electrodes within the apparatus simultaneously with sealing a gas therewithin.

Turning now to FIG. 7 there is illustrated a lamp 10 which is precisely the same as the lamp shown in FIG. 5 with the exception that the anode 12 and the cathode 14 are not yet sealed to the body 28 of the lamp 10. In the embodiment illustrated in FIG. 7 the anode 12 and the cathode 14 each have surrounding them adjacent the body 28 a sleeve 72 made of glass similar to or identical to the glass used for the bead 22. Thus, when the lamp 10 as shown in FIG. 7 is placed in the furnace 56 such as shown in FIG. 6 and the bead 22 is softened to seal the tube 16, the sleeves 72 will at the same time be softened and will seal the anode and cathode to the body 28 of the lamp 10. Thus, in a single operation the anode 12 and the cathode 14 can be sealed to the body 28 while the lamp 10 has xenon or a similar gas sealed therein at a desired pressure.

Figure 8:
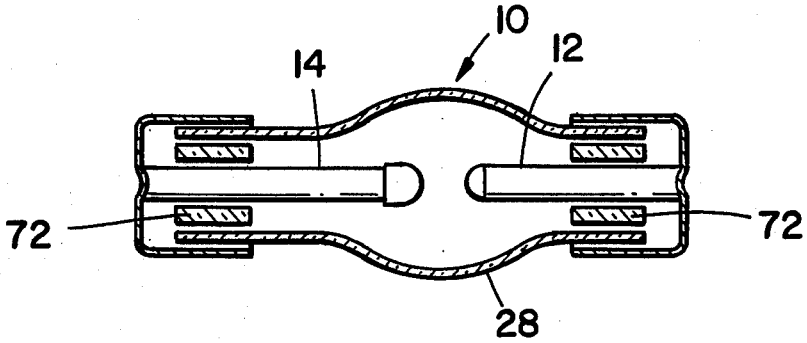
FIG. 8 illustrates a lamp sealable by the process of the present invention in the apparatus shown in FIG. 6 wherein pressurization of a gas within the lamp proceeds through what is converted in to a seal for an electrode.

Referring to FIG. 8 there is illustrated an embodiment wherein at least one of the sleeves 72 has at least one hole therethrough and is generally fritted (porous) glass and thereby serves as the bead 22 and wherein the tube 16 in this embodiment simply comprises the end of the lamp about at least one of the sleeves 72. This removes the necessity for sealing a separate tube 16 to the body 28. Gas filling proceeds within the furnace 56 and sealing of the sleeves 72 also comprises sealing of the bead 22.

PROCESS

Successful operation of the process of the present invention by any of the embodiments illustrated in the Figures of the drawings or by any equivalent apparatus requires a careful selection of materials. As has been previously stated, the body 28 may be made of any of a number of high-temperature vitreous materials for example borosilicate glass, quartz, or preferably aluminosilicate glass. The aluminosilicate type glass is preferred for several reasons as discussed previously. Also, as with quartz, the aluminosilicate glass is not attacked by a number of metal halides 73, e.g., thallium iodide, or any other compatible metal halide 73 can be sealed within the lamp 10 thereby allowing lower pressure operation, e.g., one to two atmospheres of xenon gas as contrasted with ten or more atmospheres thereof. The particular metal of the metal halide is relatively unimportant, virtually any compatible metal halide being useful. The halide may generally be a chloride, bromide or iodide. Borosilicate glass is attacked by such halides. No matter what glass is chosen for the body 28 it is essential that the material chosen for the bead 22 be most carefully selected. In particular it is essential that the bead 22 have a softening temperature below a softening temperature of the tube 16. It is further essential that the material chosen for the bead 22 be such that it will thoroughly wet the interior of the tube 16 so as to form a good pressure tight seal therewith. Further, the bead 22 after it has sealed the tube 16 must be such that it will not absorb too great an amount of the thermal or infrared radiation created by the discharge going on within the lamp 10 between the anode 12 and the cathode 14. Further yet, the material of the bead 22 must be such that no matter how much energy it may absorb from the discharge between the anode 12 and the cathode 14 it will not be raised to a temperature whereby it will soften thus causing failure of the lamp 10. Still further, the thermal expansion differential of the bead 22 must be within about 1000 parts per million of the tube 16. This is essential in order to ensure that high thermal stress will not result between the bead 22 and the tube 16 on use of the lamp 10 thereby leading to cracking or failure of the tube 16, the lamp 10, or the bead 22. It is preferred that the thermal expansion differential of the bead 22 after sealing thereof interiorly of the tube 16 be within about 600 parts per million of the tube 16. Still more preferably the thermal expansion differential between the bead 22 and the tube 16 should be no more than 200 parts per million after the bead 22 has sealed the tube 16 and been cooled.

It should be noted that the use of a furnace as illustrated in FIG. 6 is especially advantageous in that the furnace can be slowly and controllably cooled after the lamps 10 have been sealed through softening of the bead 22 and filling thereby of the tube 16 whereby the seal created about the bead 22 and for that matter the entire lamp 10 is annealed in place. This is likewise true with respect to the seals formed by the sleeves 72 with the body 28 and the anode and cathode 12 and 14. What results after cooling within the furnace 56 in a controlled annealing manner is a lamp 10 having a very low strain therein and being very stable to rapid temperature change.

It is very desirable in order to minimize thermal strains and hence lamp failures to pick a glass and a refractory metal which have thermal expansion differentials within about 1000 parts per million, preferably within about 600 parts per million and still more preferably within about 200 parts per million.

In a particularly preferred embodiment of the invention the vitreous material of the bead 22 is a material which is devitrifiable at a temperature above its softening temperature but still below the softening temperature of the tube 16. Devitrifiable vitreous material of this nature are taught for example in U.S. Pat. No. Re 25,791, No. 3,058,323 and No. 2,889,952 of S. A. Claypoole. Devitrifiable glasses which will satisfy all the requirements of the present invention are presently commercially available for example from Corning which sells them under the trademark "Pyroceram" and are contained in Corning "Product Information", "Pyroceram Brand Cements #45, #89, and #85", issued Aug. 1, 1965 by Corning Glassworks, Electronic Department, Corning, N.Y. 14830 or Kimble CV-635 crystallizing solder sealing glasses. It should be noted that such devitrifiable materials harden on devitrifying and thereafter remain hard and have thermal expansion differentials to aluminosilicate glass, tungsten and molybdenum, after devitrification, within the desired ranges, that prior to devitrification these materials soften at a temperature below the softening temperature of the preferred aluminosilicate glass, wet the preferred aluminosilicate glass, and are devitrifiable at a temperature above their softening temperature but still below the softening temperature of the preferred aluminosilicate glass. In the case where the preferred devitrifiable glass is used as the bead 22 (and in some cases also as the sleeves 72) the process of the present invention includes after heating the tube 16 and the bead 22 to a first temperature sufficient to soften the bead 22 but not soften the tube 16 to seal the tube 16 with the softened bead 22, a step of further heating the tube 16 which has been filled with the softened bead 22 to a second temperature intermediate the first temperature and the softening temperature of the tube 16 to devitrify and thereby again harden the closed bead 22 after it has first sealed the tube 16.

To understand fully the close match that will be obtained in properties by operating in the most preferred manner as described just previously, i.e., with an aluminosilicate glass such as Corning 1720 or 1723 and a devitrifiable bead such as Corning Pyroceram Cement No. 45 (Corning Code 7475 glass) and with molybdenum used for the anode and the cathode materials where they seal with the body 28 of the lamp 10, the following Table I is included which shows the softening temperatures of each of the glasses and the devitrification temperature of the cement. Table II shows the thermal expansion differentials of these and other useful materials.

Table I

| MATERIAL | SOFTENING TEMPERATURE | DEVITRIFYING TEMPERATURE |
|---|---|---|
| Corning Code 1720 | 915° C | — |
| Pyroceram No. 45 | 644° C | 750° C |

Table II

| | Thermal Expansion Differentials, ppm | | | | | |
|---|---|---|---|---|---|---|
| | 1720 | 1723 | 45 | CV-635 | Mo | W |
| Corning Code 1720 | 0 | — | 610 | 250 | 290 | 150 |
| Corning Code 1723 | — | 0 | 740 | 380 | 190 | 240 |
| Pyroceram No. 45 | 610 | 740 | 0 | — | 850 | 460 |
| Kimble CV-635 | 250 | 380 | — | 0 | 550 | 100 |
| Molybdenum (Mo) | 290 | 190 | 850 | 550 | 0 | — |
| Tungsten (W) | 150 | 240 | 460 | 100 | — | 0 |

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. A process for sealing a gas within an electronic tube such as a gas discharge lamp, comprising:

providing within a gas tight chamber which includes heating means, a hollow axially extending vitreous body having a vitreous tube integral with said body extending along said axis to an orifice, said hollow vitreous body further including a pair of electrodes extending axially thereinto a respective one of which extends through said tube, is not sealed thereto and has a vitreous bead in the form of a sleeve about said respective electrode in said tube formulated of a solder type of glass, said bead having a softening temperature below a softening temperature of said tube, said bead allowing gas transfer through said first tube to the interior of said body and having the ability to wet, seal and thereby close off said tube on softening;

evacuating said chamber and the interior of said body via said tube;

pressurizing said chamber with a gas and thereby pressurizing the interior of said body via said tube with said gas;

uniformly heating said entire chamber via said heating means and thereby uniformly heating said tube, said body and said bead with said tube and the interior of said body pressurized with said gas to a temperature intermediate the softening temperature of said bead and the softening temperature of said tube to soften said bead and wet, seal and thereby close off said tube therewith while sealing said bead to said respective electrode;

cooling said sealed body, tube and electrodes.

2. A process as in claim 1, wherein said solder glass is a devitrifiable glass having a devitrification temperature intermediate the softening temperature thereof and the softening temperature of said tube and including as an added step prior to said cooling:

further heating said body along with said tube, after said bead has been softened to wet, seal and close off said tube and seal to said respective electrode, to a devitrification temperature intermediate the softening temperature of said devitrifiable glass and said first tube to devitrify said bead.

3. A process as in claim 1, wherein the seal formed by said bead has a thermal expansion differential within about 1000 parts per million of that of said tube.

4. A process as in claim 2, wherein said devitrified bead seal has a thermal expansion differential within about 200 parts per million as that of said tube.

5. A process as in claim 1, wherein said body and said tube comprise an aluminosilicate glass.

6. A process as in claim 1, wherein at last one of said electrodes is activatable by radio frequency heating thereof and including as an added step after said evacuating and prior to said pressurizing;

generating radio frequency energy within said chamber to activate said activatable electrode.

7. A process as in claim 1, wherein said cooling comprises slowly lowering the temperature of said chamber with said sealed tube and body therewith to anneal said body and thereby generally minimize thermal stress therein.

8. A process as in claim 2, wherein said body and said tube comprise an aluminosilicate glass.

* * * * *